US005537192A

United States Patent [19]

Iguchi et al.

[11] Patent Number: 5,537,192

[45] Date of Patent: Jul. 16, 1996

[54] TRANSFER ROLLER AND TONER FOR ELECTROPHOTOGRAPHIC APPARATUS

[75] Inventors: Michihisa Iguchi; Hiroshi Hashizume; Seiji Arai; Yoshiaki Okano; Chinobu Sakai; Hirotaka Fukuyama; Takahito Kabai; Kouichirou Satou; Tetsuya Nakamura; Satoshi Katagata, all of Tokyo, Japan

[73] Assignee: Kabushiki Kaisha Toshiba, Kawasaki, Japan

[21] Appl. No.: 291,748

[22] Filed: Aug. 17, 1994

Related U.S. Application Data

[63] Continuation of Ser. No. 114,241, Aug. 31, 1993, abandoned.

[30] Foreign Application Priority Data

Aug. 31, 1992 [JP] Japan ..... 4-232408

[51] Int. Cl.[6] ..... G03G 15/14

[52] U.S. Cl. ..... 355/271; 355/210

[58] Field of Search ..... 355/271, 273, 355/274, 219, 210

[56] References Cited

U.S. PATENT DOCUMENTS

| | | | |
|---|---|---|---|
| 4,338,017 | 7/1982 | Nishikawa . | |
| 4,401,383 | 8/1983 | Suzuki et al. . | |
| 4,967,231 | 10/1990 | Hosoya et al. | 355/219 |
| 4,977,430 | 12/1990 | Florack | 355/274 |
| 5,132,738 | 7/1992 | Nakamura et al. | 355/274 |
| 5,150,165 | 9/1992 | Asai | 355/274 |
| 5,159,393 | 10/1992 | Hiroshima et al. | 355/277 |
| 5,168,313 | 12/1992 | Hosaka et al. | 355/274 |
| 5,285,245 | 2/1994 | Goto et al. | 355/271 |
| 5,323,185 | 6/1994 | Nagato et al. | 346/159 |
| 5,359,395 | 10/1994 | Shimura et al. | 355/274 X |

*Primary Examiner*—R. L. Moses

*Attorney, Agent, or Firm*—Finnegan, Henderson, Farabow, Garrett & Dunner

[57] ABSTRACT

A transfer device of a contact transfer method wherein a transfer power supply applies a predetermined transfer voltage to a transfer roller contacting the rear surface of a printing sheet, so that an electric field for causing the toner to be attracted by the transfer roller is generated. A lumped constant resistor is electrically inserted between the transfer roller and the transfer power supply. The lumped constant resistor has an electric resistance smaller than an equivalent electric resistance obtained when the whole transfer roller is regarded as one electric resistor. When the electric resistance of the printing sheet changes in accordance with a change in ambient environment, the voltage drop across the lumped constant resistor is changed to compensate for the change in electric resistance of the printing sheet.

17 Claims, 9 Drawing Sheets

TRANSFER ROLLER AND TONER FOR ELECTROPHOTOGRAPHIC APPARATUS

This application is a division of application Ser. No. 08/114,241, filed Aug. 31, 1993, now abandoned.

BACKGROUND OF THE INVENTION

1. Field of the Invention

The present invention relates to a transfer device for an electrophotographic apparatus which prints an image based on an electrophotographic process, a transfer roller used in this transfer device, and toner used for the electrophotographic apparatus.

2. Description of the Related Art

An electrophotographic apparatus forms an electrostatic latent image on a photosensitive surface of a photosensitive drum by charging the photosensitive surface to a predetermined potential (e.g., −600 V) by a charging device and exposing the photosensitive surface by an exposure device in accordance with image data. The electrostatic latent image is developed by attaching toner on the photosensitive surface by a developing device in accordance with the formed electrostatic latent image, thereby forming a toner image corresponding to the electrostatic latent image on the surface of the photosensitive drum. This toner image is transferred to a printing sheet by a transfer device. Thus, the image is printed on the printing sheet.

Transfer devices of various types of methods are available. One of such methods is the contact transfer method. A transfer device of the contact transfer method has a transfer roller contacting a photosensitive drum. Charges having a polarity opposite to that of the charges of the toner are given to the rear surface of the printing sheet inserted between the photosensitive drum and the transfer roller. Then, the toner attaching to the photosensitive drum is transferred to the printing sheet by Coulomb force.

The electric resistance of the printing sheet largely changes in accordance with the ambient environment, especially the relative humidity. In the transfer device of the contact transfer method, when the electric resistance of a printing sheet changes, the power of Coulomb force, i.e., an amount of charges that can be given to the printing sheet also changes. Therefore, the transfer capability changes in accordance with the ambient environment. This results change in the quality of the printed image.

Generally, a transfer roller comprises a sponge layer made of a conductive urethane sponge around the outer surface of a cylindrical shaft and a resistor layer made of PVDF (polyvinylidene fluoride) around the outer surface of the sponge layer. To adhere the resistor layer on the sponge layer, a binder layer is inserted between the two layers, and the resultant structure is heated to soften the binder layer.

In the transfer roller, the resistor layer conventionally has a low adhesion strength with the sponge layer, and hence the resistor layer may undesirably peel off. When the resistor layer peels off, charges cannot be correctly given to the rear surface of the printing sheet, decreasing the transfer capability.

Further, the toner easily attaches to the surface of the transfer roller. The attaching toner causes supply of the charges to the printing sheet unstable, decreasing the transfer capability.

Furthermore, in the conventional electrophotographic apparatus, a so-called "center blank" phenomenon occurs wherein the toner at the central portions of character images and thin lines is not transferred to a printing sheet to leave a white portion on the corresponding portion of the image on the printing sheet. This is because that the distribution of the toner on the photosensitive drum is not uniform and the most toner presents at the center of the line. When the printing sheet contacts the photosensitive drum, the toner is made flat by the transfer roller. Thus, the density of the toner becomes high at the center of the line. The Coulomb force between the toners is inversely proportional to the distance therebetween. Therefore, the toners at the center of the line have strong Coulomb force which prevents the toner being transferred to the printing sheet.

SUMMARY OF THE INVENTION

It is an object of the present invention to provide a transfer device for electrophotographic apparatus for decreasing the influence of the change in electric resistance of the printing sheet accompanying a change in ambient environment, thereby realizing high-quality stable transfer in different environments.

It is another object of the present invention to provide a transfer roller used in a transfer device for an electrophotographic apparatus capable of always stably giving charges to the printing sheet which is inserted between the transfer roller and a photosensitive member on which a toner image is formed, thereby stably performing high-quality transfer.

It is a further object of the present invention to provide a transfer roller used in a transfer device for an electrophotographic apparatus capable of decreasing occurrence of a so-called "center blank".

It is a still another object of the present invention to provide toner used for an electrophotographic apparatus capable of decreasing occurrence of a so-called "center blank".

According to the present invention, there is provided a transfer device for transferring toner attached to a surface of a photosensitive member to a front surface of a printing sheet, the transfer device comprising:

a transfer contact member for contacting a rear surface of the printing sheet;

power source means for applying, to the transfer contact means, a predetermined transfer voltage which generates an electric field for causing the toner to be attracted by the transfer contact member; and resistor means, connected between the transfer contact member and the power source means, having an electric resistance smaller than an equivalent electric resistance of the transfer contact element.

According to the present invention, there is provided a transfer roller used in a transfer device for an electrophotographic apparatus, the transfer roller comprising:

a sponge layer;

a resistor layer formed on an outer surface of the sponge layer; and a binder layer, located between the sponge layer and the resistor layer, for adhering the sponge layer and the resistor layer when being heated at a predetermined temperature, wherein the sponge layer is formed of a material having an endothermic point at a temperature not more than the predetermined temperature for heating the binder layer.

According to the present invention, there is provided a transfer roller used in a transfer device for transferring toner attached to a surface of a photosensitive member to a printing sheet, wherein an outer surface of the transfer roller has a surface roughness which is not more than a predetermined roughness which is set based on a particle diameter distribution of the toner.

According to the present invention, there is provided a transfer roller used in a transfer device for transferring toner attached to a surface of a photosensitive member to a printing sheet, wherein a surface hardness of the transfer roller is not more than 50 degrees in ASKER-C hardness.

According to the present invention, there is provided a transfer roller used in a transfer device for transferring toner attached to a surface of a photosensitive member to a printing sheet, wherein a surface hardness of the transfer roller is less than a surface hardness of the photosensitive member.

According to the present invention, there is provided toner used in an electrophotographic apparatus, wherein the toner is formed of a main resin and wax, an amount of the wax being more than 1.0 part by weight relative to a weight of the main resin.

Additional objects and advantages of the present invention will be set forth in the description which follows, and in part will be obvious from the description, or may be learned by practice of the present invention. The objects and advantages of the present invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which.

DETAILED DESCRIPTION OF THE PREFERRED EMBODIMENTS

A preferred embodiment of a transfer device for an electrophotographic apparatus, a transfer roller used in the transfer device, and toner used for the electrophotographic apparatus according to the present invention will now be described with reference to the accompanying drawings.

Figure 1:
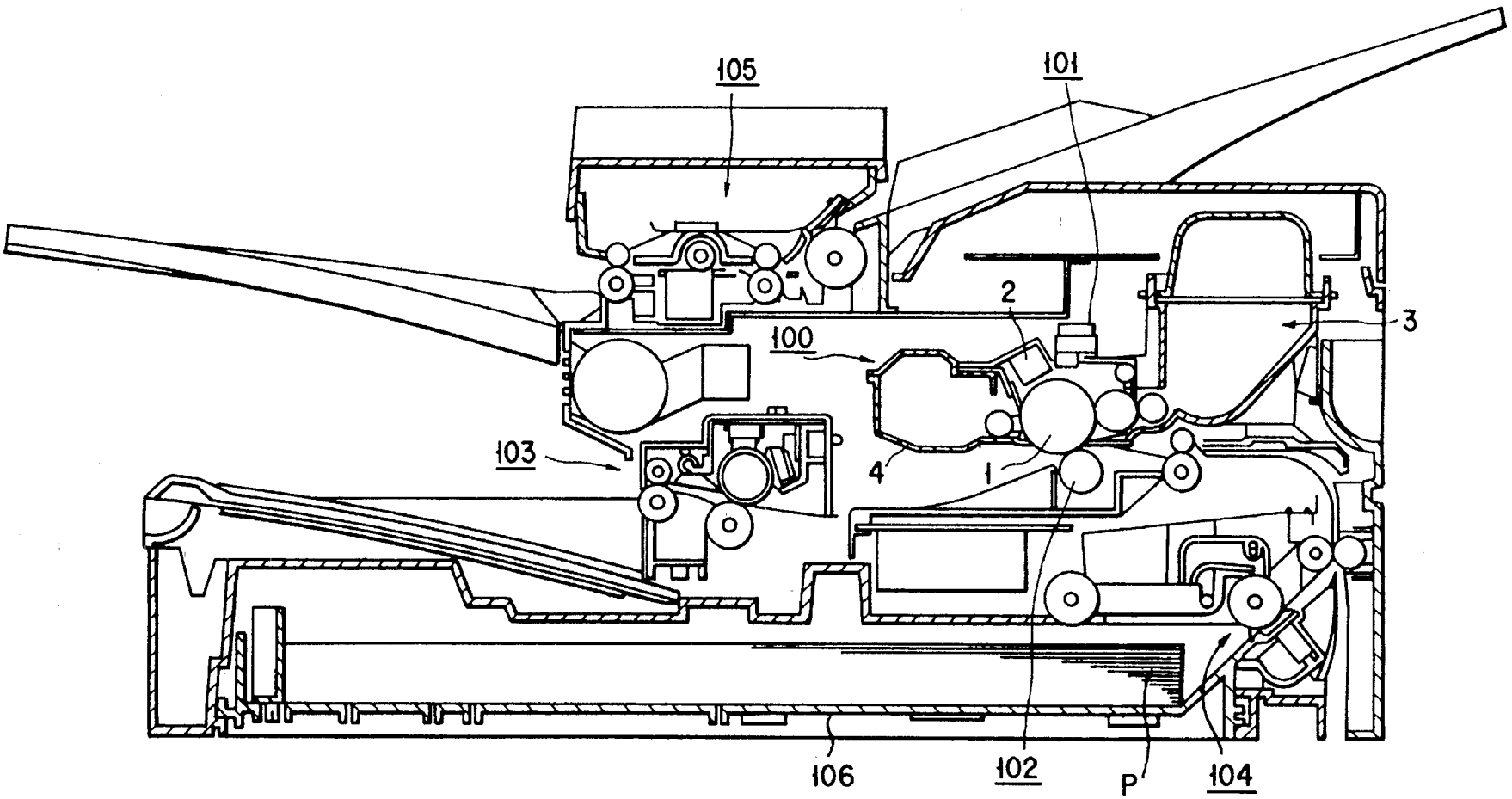
FIG. 1 is a partially sectional view showing the entire structure of a facsimile apparatus to which an electrophotographic apparatus using a transfer device according to the present invention is applied.

FIG. 1 is a partially sectional view showing the entire structure of a facsimile apparatus to which an electrophotographic apparatus using a transfer device of the present invention is given.

This facsimile apparatus has a process unit 100, an exposure device 101, a transfer device 102, a fixing unit 103, a paper feed mechanism section 104, and a transmission mechanism section 105.

The process unit 100 is formed as an integral structure of a photosensitive drum 1, a charging device 2, a developing device 3, and a cleaning device 4, and forms a toner image on the surface of the photosensitive drum 1 together with the exposure device 101 in accordance with the so-called Carlson process. The process unit 100 is detachably provided to the main body of the facsimile apparatus.

The exposure device 101 includes an LED head and forms an electrostatic latent image on the photosensitive surface of the photosensitive drum 1 by exposing the photosensitive drum 1.

The transfer device 102 transfers the toner image formed on the photosensitive drum 1 onto a printing sheet P fed by the paper feed mechanism section 104. A large number of printing sheets P are stored in a printing sheet tray 106.

The fixing unit 103 fixes the toner image transferred to a printing sheet P.

The transmission mechanism section 105 optically reads an original to be transmitted and performs photoelectric conversion to generate an image signal. The transmission mechanism section 105 is connected to a communication line (not shown).

Figure 2:
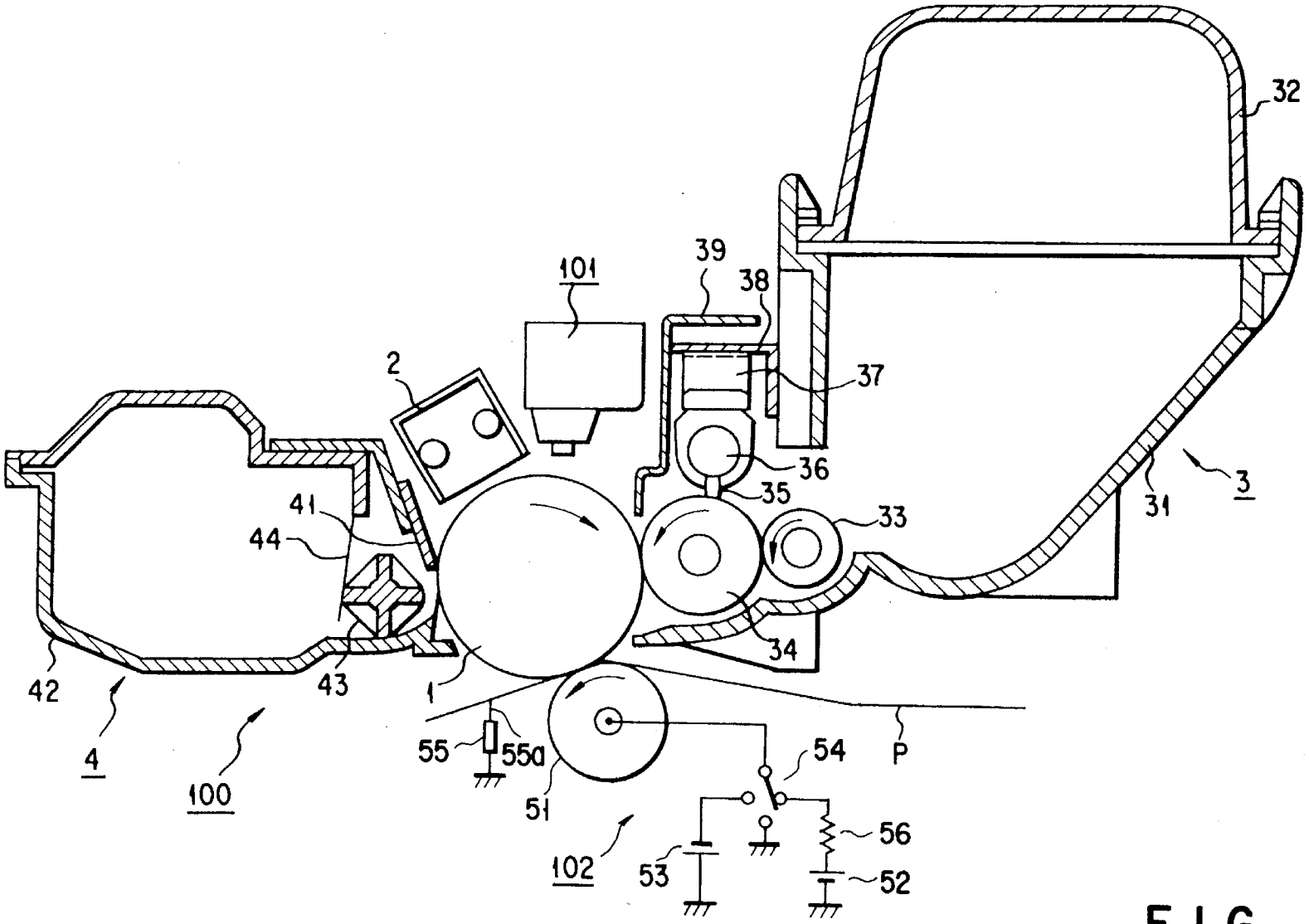
FIG. 2 is a partially sectional view showing the structure of a process unit and a transfer device in detail.

FIG. 2 is a partially sectional view showing the structure of the process unit 100 and the transfer device 102 in detail. Note that the same reference numerals are used to denote the same portions as in FIG. 1.

The photosensitive drum 1 is made of a cylindrical conductor, e.g., aluminum. The outer surface of the cylindrical conductor is coated with a photosensitive conductive material to form a photosensitive layer. The photosensitive drum 1 is rotated in the clockwise direction by a rotary drive mechanism (not shown). The charging device 2, the exposure device 101, the developing device 3, the transfer device 102, and the cleaning device 4 are arranged around the photosensitive drum 1 along the outer surface of the photosensitive drum 1. Of these components, the photosensitive drum 1, the charging device 2, the developing device 3, and the cleaning device 4 are integrally supported by side covers (not shown) to form the process unit 100.

The charging device 2 comprises, e.g., a known scorotron charger and uniformly charges the surface of the photosensitive drum 1 to a predetermined potential (e.g., −600 V).

The developing device 3 comprises a toner hopper 31, a toner pack 32, a feed roller 33, a developing roller 34, a developing blade 35, a support rod 36, a leaf spring 37, a support 38, and a reinforcing plate 39.

The toner hopper 31 is a hollow container whose side and upper surfaces are partially open, and stores toner (not shown) therein. The toner pack 32 is mounted on the upper open portion of the toner hopper 31. The toner pack 32 is a container having an open surface. The toner pack 32 is filled with the toner, and its opening is sealed with a seal sheet (not shown). When the seal sheet is removed while the toner pack 32 is mounted on the toner hopper 31 with its opening facing the toner hopper 31, as shown in FIG. 2, the toner filled in the toner pack 32 is given to the toner hopper 31.

The feed roller 33 is made of a conductive sponge and arranged at the opening on the side surface of the toner hopper 31 such that it is partly located in the toner hopper 31. The feed roller 33 contacts the developing roller 34. The developing roller 34 is arranged between the photosensitive drum 1 and the feed roller 33. The developing roller 34 contacts both the photo-sensitive drum 1 and the feed roller 33. The feed roller 33 and the developing roller 34 are rotated in the counterclockwise direction by a rotary drive mechanism (not shown). The feed roller 33 carries the toner stored in the toner hopper 31 and supplies it to the developing roller 34. The developing roller 34 carries the toner given by the feed roller 33 and causes it to contact the surface of the photosensitive drum 1.

The developing blade 35 is made of a silicone resin, urethane, or the like. The developing blade 35 is supported by the cylindrical support rod 36 arranged parallel to and above the developing roller 34 and contacts the developing roller 34. The support rod 36 is urged toward the developing roller 34 by the leaf spring 37, fixed to the support 38, with a predetermined force F (about 50 g/cm$^2$ to 100 g/cm$^2$). Thus, the developing blade 35 is urged against the developing roller 34 with the force F. The support 38 is fixed to the side wall of the toner hopper 31 which faces the photosensitive drum 1.

The reinforcing plate 39 is fixed to the support 38 and the side covers (not shown) of the process unit 100 to increase the rigidity of the process unit 100 and to prevent the toner carried by the developing roller 34 from scattering into the inside of the apparatus.

The cleaning device 4 comprises a cleaning blade 41, a used-toner storing portion 42, a used-toner collecting roller 43, and a one-way valve 44.

The cleaning blade 41 is arranged to contact the photosensitive drum 1 in order to scrape off the residual toner attaching to the photosensitive drum 1. The used-toner storing portion 42 recovers the residual toner which is not transferred to the printing sheet and is scraped from the photosensitive drum 1 by the cleaning blade 41. The used-toner collecting roller 43 conveys the toner scraped by the cleaning blade 41 to the used-toner storing portion 42. The one-way valve 44 prevents the toner in the used-toner storing portion 42 from flowing back to the photosensitive drum 1.

The transfer device 102 comprises a transfer roller 51, a transfer power supply 52, a roller cleaning power supply 53, a switch 54 for selecting the transfer power supply 52 and the roller cleaning power supply 53, a discharge brush 55, and a lumped constant resistor 56.

The transfer roller 51 contacts the photosensitive drum 1. A printing sheet P given from the printing sheet tray 106 by the paper feed mechanism section 104 is inserted between the transfer roller 51 and the photosensitive drum 1.

The transfer power supply 52 applies a predetermined transfer voltage (e.g., +1,350 V) having an opposite polarity to that of the charged potential of the toner to the transfer roller 51. The cleaning power supply 53 applies a predetermined roller cleaning voltage (e.g., −1,000 V) having an opposite polarity to that of the transfer voltage to the transfer roller 51. One of the voltages generated by the transfer power supply 52 and the roller cleaning power supply 53 is selected by the switch 54 and given to the transfer roller 51. The switch 54 can select neither the transfer power supply 52 nor the roller cleaning power supply 53 but turn off the voltage to be given to the transfer roller 51. The lumped constant resistor 56 is inserted between the transfer power supply 52 and the switch 54.

The discharge brush 55 is arranged in the vicinity of the transfer roller 51 to come close to or contact the printing sheet P that has passed between the photosensitive drum 1 and the transfer roller 51. The discharge brush 55 is electrically grounded. A bristle portion 55*a* coming close to or contacting the printing sheet P is made of a conductive acrylic resin or stainless steel.

In the facsimile apparatus having the structure as described above, an image is printed in the following manner.

First, the surface (photosensitive surface) of the photosensitive drum 1 is charged by the charging device 2 to a predetermined potential (e.g., −600 V). Subsequently, the charged photosensitive surface of the photosensitive drum 1 is exposed by the exposure device 101 in accordance with an image to be printed, thereby forming an electrostatic latent image. Then, the electrostatic latent image formed on the photosensitive surface of the photosensitive drum 1 is developed by the developing device 3.

In the developing device 3, the toner given from the toner hopper 31 mainly by the feed roller 33 is carried by the developing roller 34 and conveyed to be brought into contact with the surface of the photosensitive drum 1. When the toner carried by the developing roller 34 is conveyed, it is formed into a thin layer by the developing blade 35. When the toner passes between the developing roller 34 and the developing blade 35, the toner is charged by the friction to have the same polarity (negative) as that of the potential charged on the photosensitive drum 1. Since a low-voltage developing bias (e.g., −200 V) having the same polarity as that of the potential charged on the photosensitive drum 1 is applied to the developing roller 34 from a developing bias power supply (not shown), the toner selectively attaches to the photosensitive drum 1 by the function of the electric field produced in accordance with the electrostatic latent image, the developing bias, and the charge of the toner. More specifically, the toner does not attach to the non-exposed portion of the photosensitive drum 1 since the potential at this portion of the photosensitive drum 1 is more negative than that of the toner, and the toner attaches to the exposed and discharged portion of the photosensitive drum 1 since the potential at this portion of the photosensitive drum 1 is less negative than that of the toner. In this manner, a toner image corresponding to the electrostatic latent image is formed on the surface of the photosensitive drum 1. This toner image is transferred to the printing sheet P by the transfer device 102.

In the transfer device 102, when the image is to be transferred, the switch 54 selects the transfer power supply 52 and a positive transfer voltage (e.g., +1,350 V) is given to the transfer roller 51. The printing sheet P which has been conveyed by the paper feed mechanism section 104 is inserted between the photosensitive drum 1 and the transfer roller 51, and charges are given to the rear surface of the printing sheet P from the transfer roller 51. Since the charges given to the rear surface of the printing sheet P are positive, the negatively charged toner is attracted by the printing sheet P. Then, the toner image formed on the surface of the photosensitive drum 1 is transferred to the printing sheet P.

After the printing sheet P is separated from the photosensitive surface of the photosensitive drum 1, the toner which is not transferred and remains on the surface of the photosensitive drum 1 is removed by the cleaning device 4.

The charges given to the printing sheet P are removed by the discharge brush 55. Since the bristle portion 55*a* of the discharge brush 55 is made of the conductive acrylic resin or stainless steel, it will not be easily broken or bent, so that it can stably come close to or contact the printing sheet P. Therefore, the charges given to the printing sheet P can be stably removed. Since the bristle portion 55*a* will not be easily broken or bent, leakage caused when the bristle portion 55*a* is undesirably kept contacting the transfer roller 51 can be prevented. It is preferable that the bristle portion 55*a* is constituted by the acrylic resin rather than stainless steel. This is because in the former case the bristle has a better flexibility to perform more stable discharge.

The structure and operation of the electrophotographic apparatus have been roughly described. The electrophotographic apparatus will be described in more detail.

Figure 3:
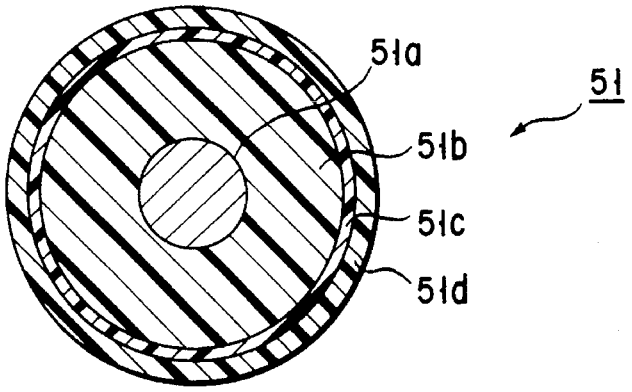
FIG. 3 is a sectional view showing a transfer roller in detail.

FIG. 3 is a sectional view showing the transfer roller 51 in detail. The transfer roller 51 comprises a cylindrical shaft 51*a*, a sponge layer 51*b* formed of a conductive urethane sponge on the outer surface of the shaft 51*a*, and a resistor layer 51*d* formed of PVDF (polyvinylidene fluoride) on the outer surface of the sponge layer 51*b*. The conductive urethane sponge constituting the sponge layer 51*b* is obtained by dispersing carbon in a urethane sponge to provide a conductivity of about $10^5$ Ω.cm$^2$. PVDF constituting the resistor layer 51*d* has a suppressed electric resistance of about $10^8$ Ω.cm$^2$.

The resistor layer 51*d* is adhered to the sponge layer 51*b* by inserting a binder layer 51*c* formed of polyvinyl chloride between them and heating the resultant structure to soften the binder layer 51*c*. If the sponge layer 51*b* is not softened and only the binder layer 51*c* is softened, the adhesion strength between the sponge layer 51*b* and the resistor layer 51*d* is decreased. Then, the resistor layer 51*d* may undesirably peel off. Therefore, a conductive urethane sponge having an endothermic point at a heating temperature (e.g., 150° C.) or less for softening the binder layer 51*c* is used to constitute the sponge layer 51*b*.

Figure 4:
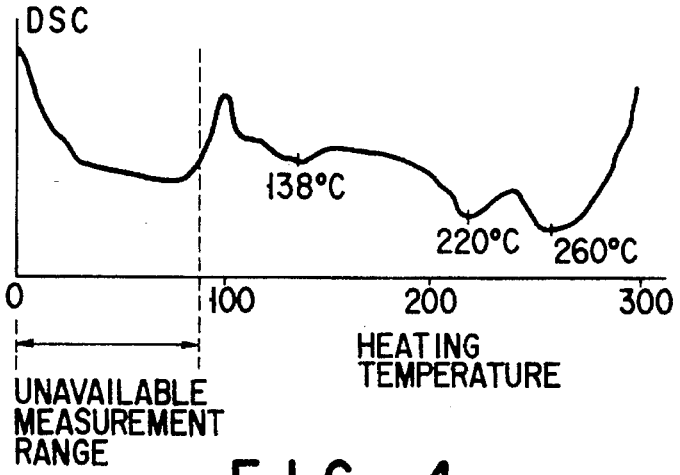
FIG. 4 is a graph showing a DSC curve obtained when differential thermal analysis (DSC measurement) of a conductive urethane sponge constituting a sponge layer of the transfer roller is performed.

FIG. 4 is a graph showing a DSC curve obtained when differential thermal analysis (DSC measurement) of the conductive urethane sponge constituting the sponge layer 51*b* is performed. A DSC curve shows a difference between the amounts of heat of a sample (conductive urethane sponge in this case) and a predetermined reference material having the same weight and volume that are obtained when the sample and the predetermined reference material are heated under the same condition. Note that the reference material is a material whose amount of heat linearly changes in accordance with a change in heating temperature.

A local minimum point of this DSC curve is the endothermic point. More specifically, in FIG. 4, the endothermic points are present at 138° C., 220° C., and 260° C. Although a local minimum point is also present below 138° C., this is not defined as an endothermic point as this is within an unavailable measurement range. The unavailable measurement range is a range in which the measurement result becomes incorrect due to unstable heating.

As is apparent from FIG. 4, the conductive urethane sponge constituting the sponge layer 51*b* has an endothermic point at 138° C. lower than 150° C. which is the heating temperature for softening the binder layer 51*c*.

Therefore, when the binder layer 51*c* is softened, the conductive urethane sponge is also softened. Accordingly, the sponge layer 51*b* and the resistor layer 51*d* can be adhered to each other well to obtain a sufficiently high adhesion strength. If the sponge layer 51*b* and the resistor layer 51*d* are adhered to each other with a sufficiently high adhesion strength, the resistor layer 51*d* is prevented from peeling from the sponge layer 51*b*. Then, the transfer roller 51 can be maintained at an optimum state for performing transfer of the toner image.

Figure 5:
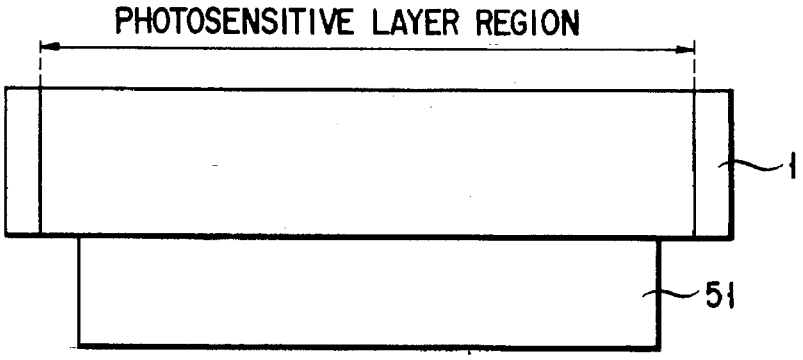
FIG. 5 is a view showing the difference in width of a photosensitive drum and the transfer roller.

The length of the transfer roller 51 (dimension in its longitudinal direction) is smaller than the width of the photosensitive layer region of the photosensitive drum 1, as shown in FIG. 5. The transfer roller 51 contacts the photosensitive layer region of the photosensitive drum 1 over its entire width.

Then, the photosensitive drum 1 and the transfer roller 51 are insulated from each other by the photosensitive layer, and a current will not leak from the transfer roller 51 to the photosensitive drum 1. Therefore, the voltage can be stably given to the transfer roller 51 without a voltage drop due to the leakage current to the photosensitive drum 1. When the photosensitive drum 1 and the rollers 33, 34, and 51 rotate but the printing sheet P is not inserted between the photosensitive drum 1 and the transfer roller 51, the photosensitive layer region of the photosensitive drum 1 is stably charged to a high potential. Therefore, almost no toner attaches to the photosensitive drum 1, and hence the transfer roller 51 is prevented from being soiled by the toner.

The surface of the transfer roller 51 has a roughness R satisfying the following condition:

$$R \leqq \mu - 2.32635\sigma$$

where R is the surface roughness (ten-point average roughness with a scanning length of 2.5 mm), and μ and σ are an average particle diameter and a standard deviation of the toner which is obtained on the basis of a distribution of particle diameter with regard to volume.

The ten-point average roughness is the average of measurement results of a total of ten points, including five points counted from the largest and five points counted from the smallest, when the distance from a certain reference position to the surface is measured over a predetermined scanning length (2.5 mm in this case).

Figure 6:
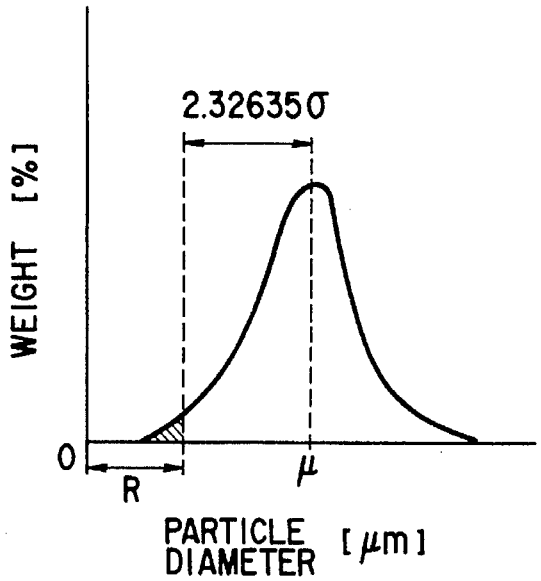
FIG. 6 is a graph showing a particle size distribution of toner with regard to volume.

The particle diameters of the toner are not uniform but have a distribution as shown in FIG. 6. FIG. 6 shows a frequency distribution of particle diameter with regard to volume. In this volume reference particle size distribution, the range of 2.32635σ is as shown in FIG. 6. The range of the surface roughness R of the transfer roller 51 is as shown in FIG. 6. To measure the average particle diameter and particle size distribution of the toner, a Colter Multisizer Model II (manufactured by Colter Co.) is used.

Therefore, the toner particles having a diameter smaller than the unevenness of the surface of the transfer roller 51 are within the hatched range in FIG. 6 which is present only in a very low probability in this volume reference particle size distribution. More specifically, [2.32635] is a coefficient with which the probability of presence of toner particles having a diameter smaller than μ–2.32635σ is about 1% in this volume reference particle size distribution. When [R=μ–2.32635σ], the probability of presence of toner particles having a diameter smaller than the unevenness of the surface of the transfer roller 51 is about 1% in this volume reference particle size distribution.

When the photosensitive drum 1 and the rollers 33, 34, and 51 rotate but the printing sheet P is not inserted between the photosensitive drum 1 and the transfer roller 51, the photosensitive surface of the photosensitive drum 1 is basically uniformly charged and the toner should not attach to it. However, in the toner, toner particles that are positively charged due to polarization among toner particles are present, although in a small amount, and they attach to the photosensitive drum 1, thereby causing so-called fogging. Alternately, when, e.g., a paper jam occurs, sometimes the toner remains on the photosensitive drum 1. In these cases, the toner contacts the transfer roller 51, thereby soiling the transfer roller 51 by the toner.

In this embodiment, however, since the surface of the transfer roller 51 is made smooth, as described above, most (about 99% of the volume reference) toner particles have a diameter larger than the unevenness of the surface of the transfer roller 51. Accordingly, the toner particle will not be fitted into the unevenness of the surface of the transfer roller 51 to attach to the transfer roller 51, thereby preventing the transfer roller 51 from being soiled by the toner.

The sponge layer 51*b* has a sponge hardness of 40 degrees or less in ASKER-C hardness. The resistor layer 51*d* has a thickness of 80 μm and has a sponge hardness of about 10 degrees in ASKER-C hardness. Therefore, the surface hardness of the transfer roller 51 is 50 degrees or less in ASKER-C hardness.

In this manner, when the surface hardness of the transfer roller 51 is set to 50 degrees or less in ASKER-C hardness, the center blank is prevented from being occurred.

The reason why the occurring of the center blank is prevented will be described in detail.

Figure 7:
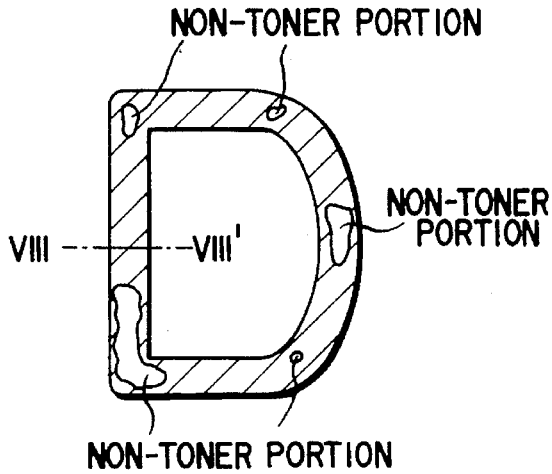
FIG. 7 is a view showing an example of a so-called "center blank"

Center blank is, as shown in, e.g., FIG. 7, a phenomenon in which the toner particles on the central portion of a character image and a thin line are not transferred to a printing sheet P and thus the corresponding portion remains as a blank (non-toner) portion in the image on the printing sheet P. In FIG. 7, the hatched region is a region where the toner particles are transferred to form a black portion.

Figure 8:
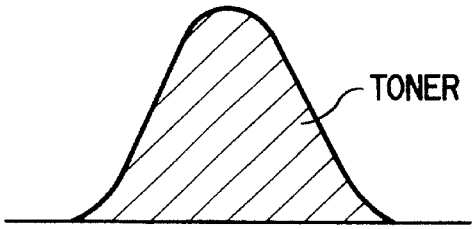
FIG. 8 is a view showing the sectional view of toner attached to the surface of the photosensitive drum at a portion indicated by VIII–VIII' of FIG. 7.

Non-toner portion is supposed to be appeared by the following factor. The toner corresponding to, e.g., the portion indicated by VIII–VIII' of FIG. 7 attaches to the surface of the photosensitive drum 1 in a state shown in FIG. 8. In other words, this portion is a mass of toner particles (toner mass), and the closer to the central portion of the toner mass, the more the toner particles. The toner in this state is made flat by the printing sheet P when the printing sheet P is brought into contact with the photosensitive drum 1. Since more toner particles are present on a portion closer to the central portion of the toner mass, after being made flat by the printing sheet P, the closer to the central portion of the toner mass, the higher the density of the toner particles, and the smaller the gap among the toner particles.

Between the photosensitive drum 1 and the transfer roller 51, the toner particles are present in an electric field generated by the charges on the photosensitive drum 1 and the transfer voltage from the transfer power supply 52. Accordingly, polarization occurs among the toner particles. Since the Coulomb force between the toner particles is inversely proportional to the square of the gap between them, the Coulomb force is supposed to be higher at a portion closer to the central portion of the toner mass.

In this manner, since the Coulomb force that causes the toner to attach to the photosensitive drum 1 is higher at a portion closer to the central portion of the toner mass, the toner particles cannot sometimes be completely transferred to the printing sheet only with the Coulomb force caused by the transfer voltage, thereby supposedly causing the white portion at the central portion of a character image and a thin line.

In contrast to this, according to the present embodiment, since the surface hardness of the transfer roller 51 is set to 50 degrees or less in ASKER-C hardness, the surface of the transfer roller 51 becomes relatively softened, and the force urging the printing sheet P against the photosensitive drum 1 is decreased. Therefore, the toner mass attaching to the photosensitive drum 1 will not be excessively made flat or compressed. The Coulomb force among the toner particles caused by polarization can be suppressed such that the toner particles can be attracted by the printing sheet P by the Coulomb force caused by the transfer voltage. As a result, the toner can be reliably transferred by the Coulomb force of the transfer voltage, decreasing the proportion of the non-toner portion in the central portion of a character image and a thin line.

Figure 9:
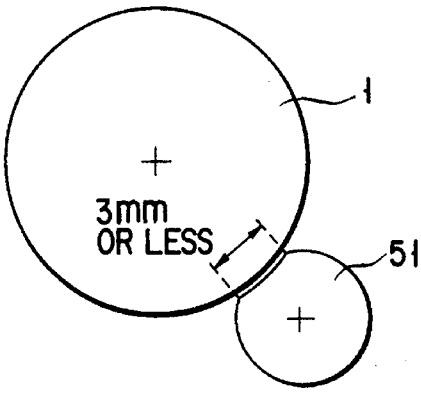
FIG. 9 is a view showing a nip width of the transfer roller against the photosensitive drum.

Center blank can also be prevented from being appeared by setting the outer diameter of the transfer roller 51 and the pressure of the transfer roller 51 against the photosensitive drum 1 such that the nip width of the transfer roller 51 against the photosensitive drum 1 becomes 3 mm or less, as shown in FIG. 9. With this countermeasure as well, the toner mass attaching to the photosensitive drum 1 can be prevented from being excessively compressed or made flat, and the toner can be reliably transferred by the Coulomb force of the transfer voltage.

Further, center blank can be prevented from being appeared by setting the proportion (addition amount) of a wax to be internally added to the toner to 1.0 part by weight or more with respect to the weight of a main resin. This is because the physical adhesive force of the toner with respect to the photosensitive drum 1 is decreased.

The reason why the addition amount of the wax is set to 1.0 part by weight or more with respect to the weight of the main resin will be described.

Figure 10:
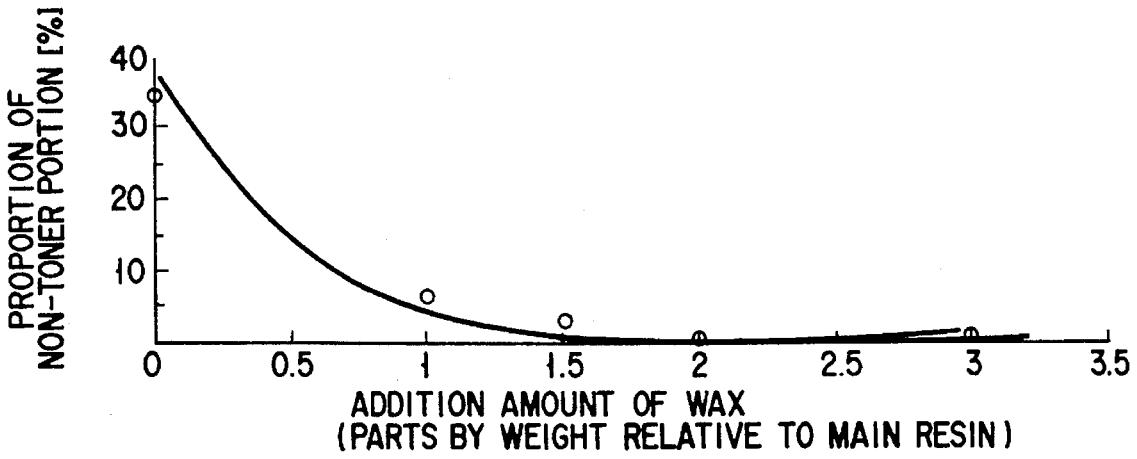
FIG. 10 is a graph showing the proportion of non-toner portion with respect to the addition amount of a wax relative to a main resin.

When the proportion of non-toner portion with respect to the addition amount of the wax was measured, the result as shown in FIG. 10 was obtained. The proportion of non-toner portion was defined as the ratio of the area of the white portion to the whole area of a character image to be printed. The proportion of non-toner portion was calculated by (S'/S)×100 (%) where S is the whole area of the character image to be printed and S' is the area of the non-toner portion. The area S' of the non-toner portion was measured under the following conditions. An elongated vertical line chart having a predetermined area is printed. The distribution of density of the vertical line of this printed image is measured by an image evaluating system (manufactured by Tokyo Kodenshi Co.). The obtained distribution of density is binarized with a threshold level (=1) to separate the density distribution into a black region and a white region. The area S' of the non-toner portion is measured in accordance with this separated distribution.

The toner is made in accordance with the following manner. Toner particles are formed of a binding resin (main resin) obtained by pulverizing a polyester-based resin, a carbon black (coloring agent), a charge control agent (CCA), and a wax (PP or PE). Silica is externally added to the toner particles for the purpose of maintaining flowability and protecting the particles, thereby obtaining the toner. The toner diameter is 7 to 15 μm.

Generally, if the proportion of non-toner portion is 5% or less, no visual problem arises. In the characteristics shown in FIG. 10, the proportion of non-toner portion is 5% or less when the addition amount of wax is 1.0 part by weight or more.

Note that if the addition amount of wax is excessively large, the adhesive force of the toner with respect to the printing sheet P is decreased, thereby decreasing the density of the complete black portion or solid portion. In addition, since a large mount of wax oozes out to the surface of the toner particles, filming occurs at portions of the developing roller 34, the developing blade 35, the photosensitive drum 1, the cleaning blade 41, or the like that contact the toner, causing an inconvenience such as abnormal friction. Therefore, the addition amount of wax is preferably 4.0 parts by weight or less.

Center blank can be sufficiently prevented from being appeared if control of the surface hardness of the transfer roller 51, control of the nip width of the photosensitive drum 1 and the transfer roller 51, or adjustment of the amount of wax of the toner is separately performed. However, if these control and adjustment processes are performed simultaneously, a greater effect can be obtained.

The electrical resistance of a printing sheet P largely changes in accordance with the ambient environment (especially relative humidity).

Figure 11:
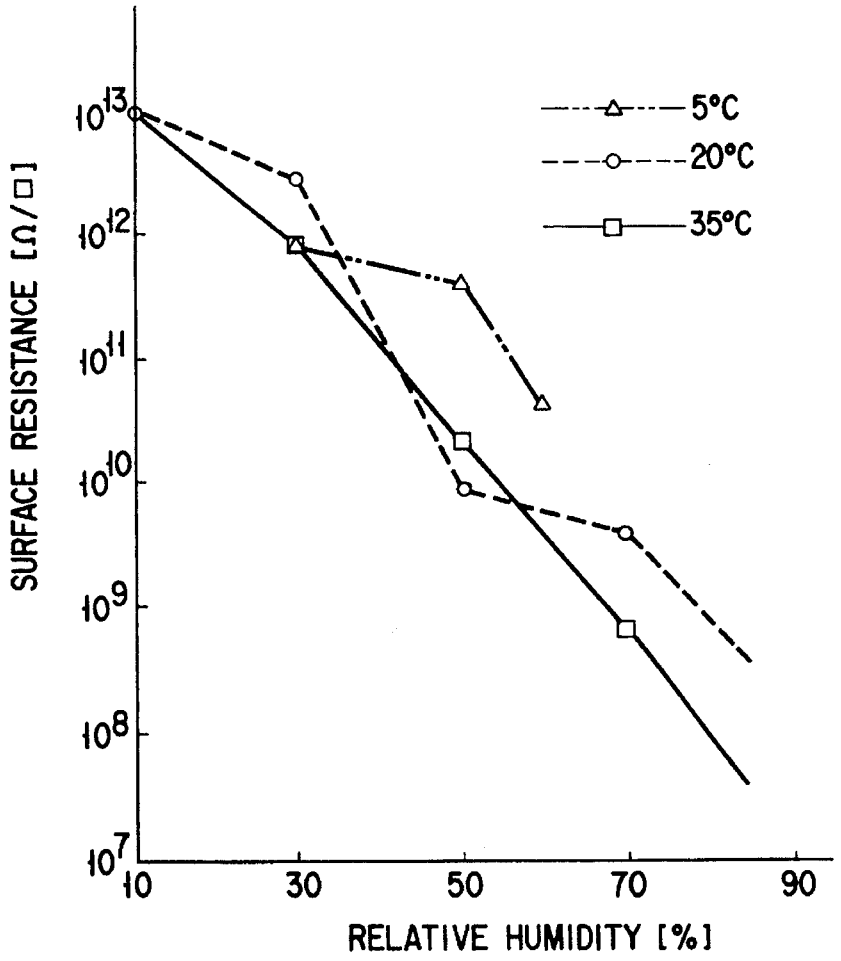
FIG. 11 is a graph showing an example of a change in surface resistance of a printing sheet with respect to a change in relative humidity.

FIG. 11 is a graph showing an example of a change in surface resistance of a printing sheet P with respect to a change in relative humidity. As is apparent from FIG. 11, when the relative humidity changes from 30% (low humidity) to 85% (high humidity), the surface resistance of the printing sheet P changes from $10^{12}$ Ω/□ to $10^{8}$ Ω/□ by about ten thousand times.

As in this embodiment, when the contact transfer method using a transfer roller is employed, the influence of the surface resistance of the printing sheet P can be decreased when compared to a case wherein the corona transfer method is employed. Further, when the transfer roller 51 is semiconductive, a variation in voltage providing a maximum transfer efficiency, which is caused depending upon the ambient environment, can be decreased. However, a variation in voltage providing a maximum transfer efficiency is small only relatively and present to some extent. The present invention aims to also reduce this minor variation.

Figure 12:
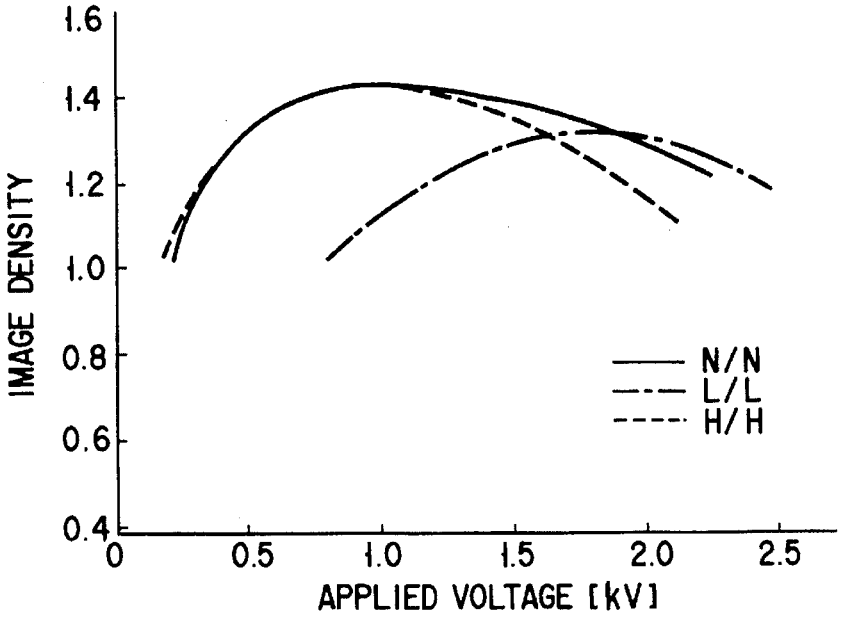
FIG. 12 is a graph showing the relationship between the voltage applied to the transfer roller and the density of an image in the roller transfer method using a semiconductive transfer roller.

FIG. 12 is a graph showing a general relationship between the voltage applied to a transfer roller and an image density in the roller transfer method that uses a semiconductive roller. As shown in FIG. 12, a voltage applied to the transfer roller for providing the maximum transfer efficiency and the maximum image density differs depending on the ambient environments. The reason for this will be described.

In FIG. 12, N/N indicates an environment with a temperature of 20° C. (normal temperature) and a humidity of 50% (normal humidity), L/L indicates an environment with a temperature of 5° C. (low temperature) and a humidity of 30% (low humidity), and H/H indicates an environment with a temperature of 35° C. (high temperature) and a humidity of 85% (high humidity). Assuming that the resistance of the toner layer, the charge amount of the toner, and the attaching amount of the toner to the photosensitive drum 1 do not vary among the different environments, the electric field that provides the maximum transfer efficiency is supposed to be the same in the respective environments.

In the environment L/L, since the electric resistance of the printing sheet in the direction of thickness is greatly increased, only a small current of several μA flows and a large voltage drop is caused in the printing sheet. Therefore, to obtain an electric field for providing the maximum transfer efficiency, the voltage to be applied to the transfer roller must be increased.

In the environment H/H, since the electric resistance of the printing sheet in the direction of thickness is relatively decreased, the voltage drop in the printing sheet is decreased. This decrease in electric resistance of the printing sheet in the direction of thickness causes a current to flow in the toner layer to apply to the toner charges having an opposite polarity to the toner, thereby easily causing inverse transfer. Therefore, the voltage to be applied to the transfer roller in order to obtain an electric field for providing the maximum transfer efficiency is lower than that in the environment L/L.

In this manner, the transfer efficiency varies depending on the ambient environments and interferes with stable transfer.

Therefore, according to the present invention, as shown in FIG. 2, the lumped constant resistor 56, e.g., a carbon-coated resistor is inserted between the transfer power supply 52 and the switch 54 to compensate for a variation in transfer efficiency caused by a change in ambient environment. The lumped constant resistor 56 has a resistance smaller than the equivalent resistance obtained when the transfer roller 51 is regarded as one resistor. The equivalent resistance obtained when the transfer roller 51 is regarded as one resistor is obtained by dividing the product of the volume resistivity of the resistor layer **51*d* of the transfer roller 51 and the thickness of the resistor layer 51*d* by the contact area of the photosensitive drum 1 and the transfer roller 51. Note that the product of the volume resistivity of the resistor layer 51*d* of the transfer roller 51 and the thickness of the resistor layer 51*d*** is within a range of $1\times10^{7}$ to $5\times10^{10}$ Ω.cm$^2$.

Figure 13:
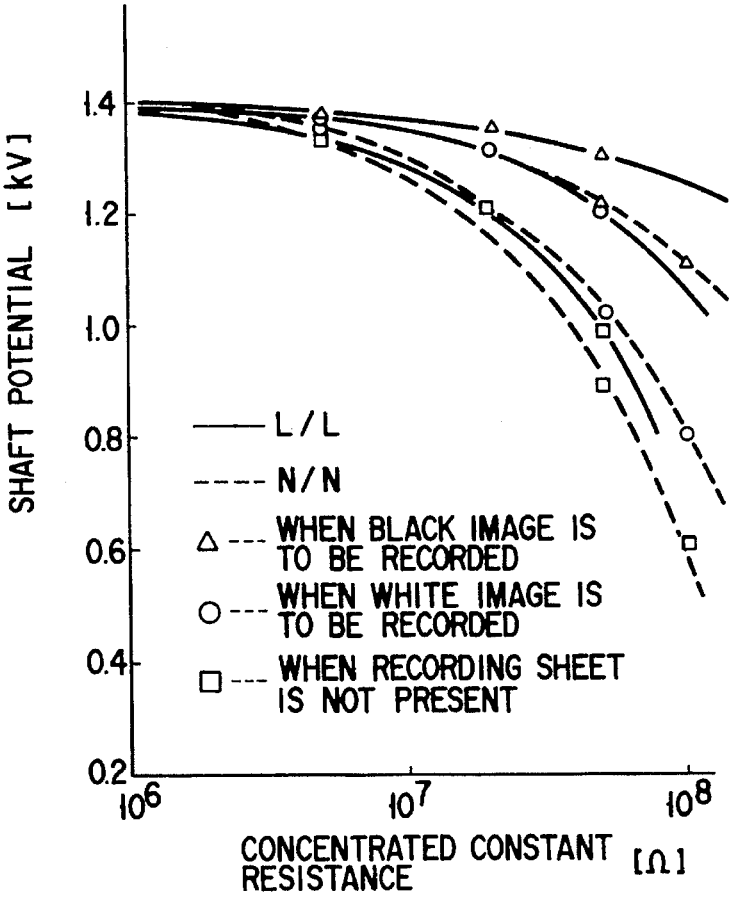
FIG. 13 is a graph showing the relationship between the resistance of a lumped constant resistor and the potential of a shaft when the transfer voltage generated by a transfer power supply is set to 1.4 kV.

FIG. 13 shows the relationship between the resistance of the lumped constant resistor 56 and the potential of the shaft **51*a* of the transfer roller 51 (to be referred to as a shaft potential hereinafter) when the transfer voltage generated by the transfer power supply 52 is set to 1.4 kV. As is apparent from FIG. 13, as the resistance of the lumped constant resistor 56 is increased, the shaft potential decreases. When a complete black or solid image is printed, in the L/L environment, the shaft potential does not drop much and is substantially equal to the voltage of the transfer power supply 52, whereas in the N/N environment the shaft potential largely drops. When the photosensitive drum 1 and the rollers 33, 34, and 51 rotate but the printing sheet P is not inserted between the photosensitive drum 1 and the transfer roller 51**, the shaft potential further decreases.

The characteristics of the shaft potential will be decreased in detail by using an equivalent circuit.

Figure 14A:
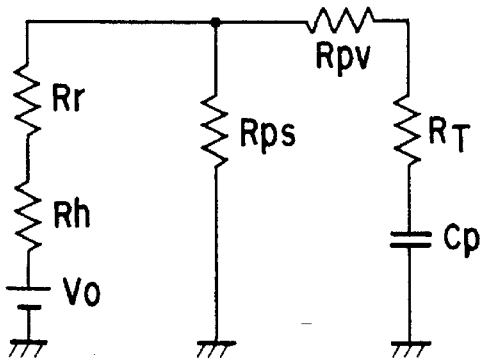
FIGS. 14A, 14B, and 14C are equivalent circuit diagrams showing the relationship among the photosensitive drum, the transfer roller, the transfer power supply, and the lumped constant resistor.
Figure 14B:
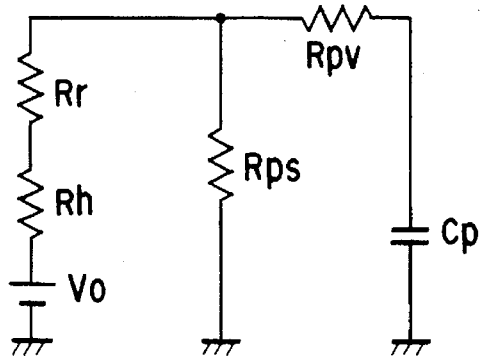
Figure 14C:
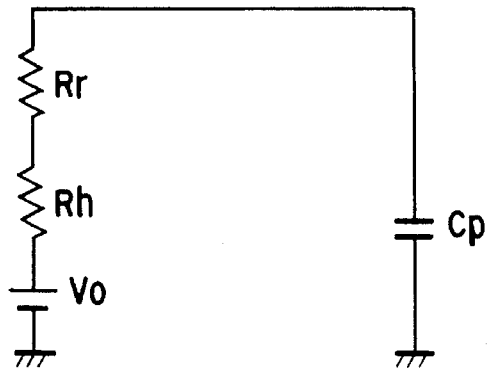

FIGS. 14A, 14B, and 14C are equivalent circuit diagrams when a solid or complete black image is to be printed, when a white image (an image having a low black ratio) is to be printed, and when the photosensitive drum 1 and the rollers 33, 34, and 51 rotate but the printing sheet P is not inserted between the photosensitive drum 1 and the transfer roller 51, respectively. Referring to FIGS. 14A to 14C, reference symbol Vo denotes the power supply voltage of the transfer power supply 52; Rh, the resistance of the lumped constant resistor 56; Rr, the electric resistance of the transfer roller 51; Rps, the surface resistance of the printing sheet P; Rpv, the resistance of the printing sheet P in the direction of thickness; Rt, the electric resistance of the toner layer on the photosensitive drum 1; and Cp, the electrostatic capacitance of the photosensitive drum 1.

When a solid or complete black image is to be printed, in the environment L/L, since the resistances Rr, Rps, and Rpv are very large, almost no current flows in the equivalent circuit, and almost no voltage drop occurs in the lumped constant resistor 56. More specifically, the potential Vo is directly applied to the shaft 51*a*. In the environment N/N or H/H, the resistances Rr, Rps, and Rpv decrease, and a current easily flows in the equivalent circuit. However, since a large amount of toner attaches to the surface of the photosensitive drum 1 to increase the resistance Rt, a current hardly flows to the photosensitive drum 1 but mostly flows to ground through the resistance Rps of the printing sheet P. This current flow to ground causes a voltage drop in the resistance Rh of the lumped constant resistor 56, thereby decreasing the shaft potential.

When a printing sheet P is not present, since voltage drop occurs in the resistance Rt of the lumped constant resistor 56 and the lumped constant resistor 56 inhibits unnecessary charges from being given to the photosensitive drum 1, the charge potential of the photosensitive drum 1 will not be disturbed.

As described above, since the lumped constant resistor 56 is provided, when the resistance of the printing sheet P is large, a large voltage is applied to the shaft 51*a* of the transfer roller 51, and when the resistance of the printing sheet P is small, a small voltage is applied to the shaft 51*a* of the transfer roller 51. As a result, a change in resistance of the printing sheet P is compensated for, and a variation in density of the printed image caused by a change in ambient environment is decreased.

In order to realize high-quality transfer in all of the environments L/L, N/N, and H/H, it is preferable to set the transfer voltage and the resistance of the lumped constant resistor 56 as follows.

Figure 15:
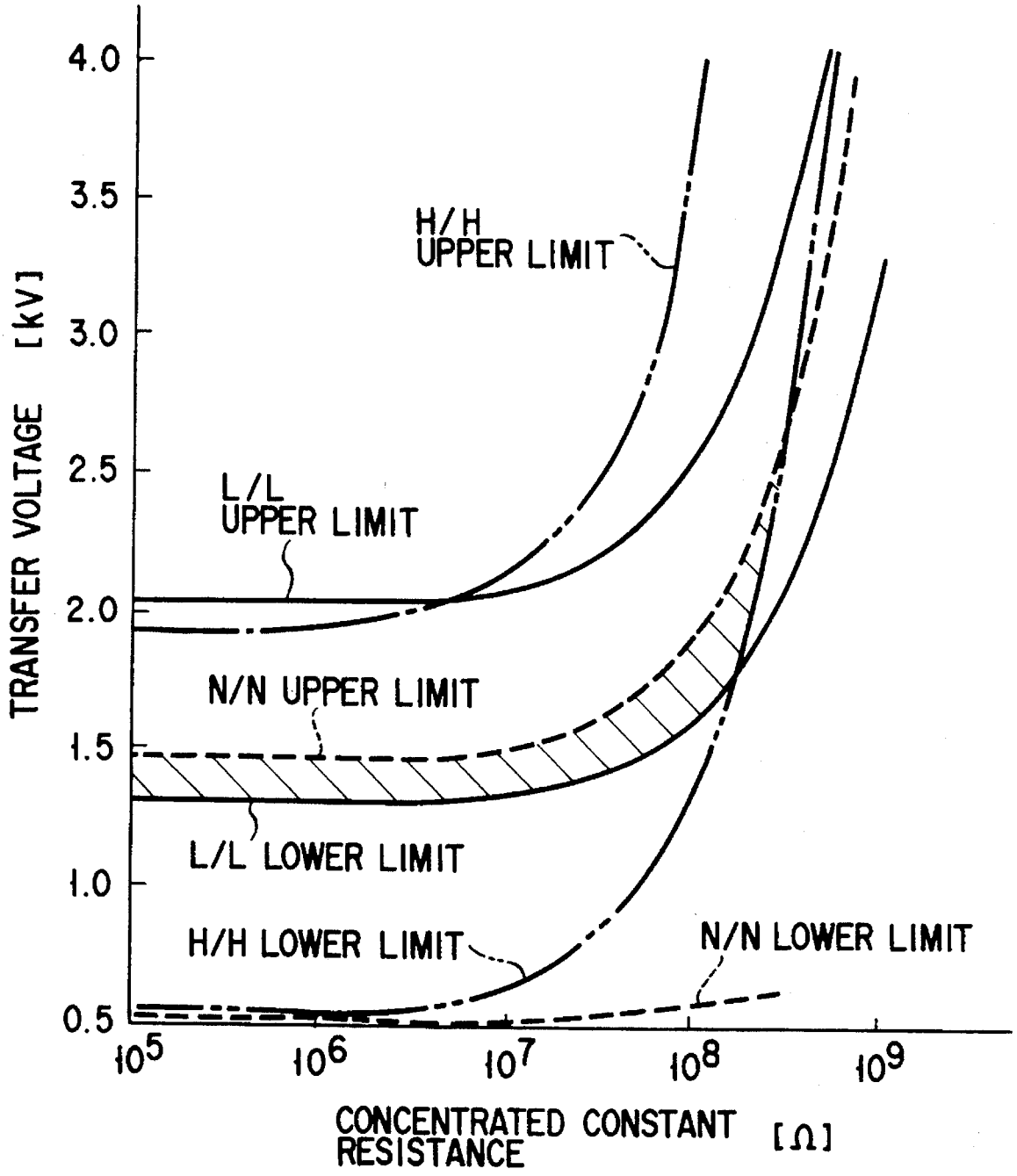
FIG. 15 is a graph showing the range of a transfer voltage generated by a transfer power supply and a lumped constant resistance required for obtaining a high-quality image in environments low temperature/low humidity, normal temperature/normal humidity, and high temperature/high humidity, respectively.

FIG. 15 is a graph showing the range of a transfer voltage of the transfer power source 52 and a lumped constant resistance required for obtaining a high-quality image in the environments L/L, N/N, and H/H, respectively. More specifically, it is apparent from FIG. 12 that in, e.g., the environment N/N, the range of the shaft potential required for obtaining a high-quality image has an upper limit of 1.4 kV and a lower limit of 600 V. The transfer voltage and the lumped constant resistance are changed to calculate curves providing an upper limit shaft potential of 1.4 kV and a lower limit shaft potential of 600 V, thereby obtaining the N/N upper and lower limit curves represented by broken lines. The area sandwiched between the N/N upper and lower limit curves is the range of the transfer power supply voltage and the lumped constant resistance required for obtaining a high-quality image in the environment N/N. Similarly, curves in the environments L/L and H/H are obtained likewise.

A common range of the ranges of the transfer power supply voltage and the lumped constant resistance required for obtaining a high-quality image in the environments L/L, N/N, and H/H, that is, the hatched range in FIG. 15 is the range of the transfer power supply voltage and the lumped constant resistance allowing high-quality image printing in any of these environments. In FIG. 15, when the transfer power supply voltage and the lumped constant resistance are set such that they are positioned in the hatched range, high-quality transfer can be realized in all environments.

Even if the lumped constant resistance does not satisfy the above condition, the influence of the ambient environment can be decreased when compared to a case wherein the lumped constant resistor 56 is not provided. However, the lumped constant resistance must be smaller than the equivalent electric resistance obtained when the transfer roller 51 is regarded as one resistor. This is due to the following reason.

The transfer roller 51 has the smallest volume resistivity, e.g., about $5\times10^8$ $\Omega.^2$ in the environment H/H. The roller resistance Rr in the equivalent circuits shown in FIGS. 14A to 14C is determined by considering the area of the transfer nip portion (the contact portion of the photosensitive drum 1 and the transfer roller 51 shown in FIG. 9 ). Assuming that the transfer nip is 1.3 mm and the length of the transfer roller 51 (the dimension in its longitudinal direction) is 260 mm, Rr is $1.48\times10^8$ $\Omega$, which substantially coincides with the upper limit of the lumped constant resistance Rh, as shown in FIG. 15. More specifically, the optimum range of the lumped constant resistance Rh is smaller than that of the electric resistance Rr of the transfer roller 51. This is because when the lumped constant resistance Rh is larger than the electric resistance Rr of the transfer roller 51, the voltage drop in the resistance Rh of the lumped constant resistor 56 becomes large, and the potential applied to the shaft 51*a* becomes very small. When the potential applied to the shaft 51*a* is excessively small, a decrease in transfer capability is caused.

In this embodiment, a change in transfer efficiency caused by a change in ambient environment is compensated for by the lumped constant resistor 56. However, the same effect can be obtained by the following structure.

Figure 16:
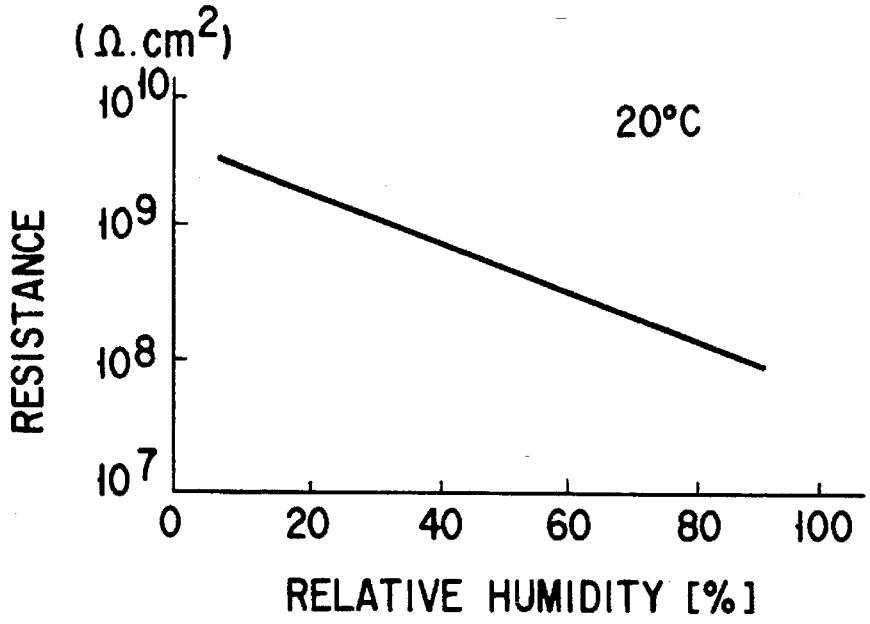
FIG. 16 is a graph showing the relative humidity-resistance characteristic curve of the transfer roller.

First, as shown in FIG. 16, a transfer roller 51 is formed such that it has relative humidity-resistance characteristics wherein the electric resistance changes by about ten to thousand times in the relative humidity range of 20% to 90%.

Figure 17:
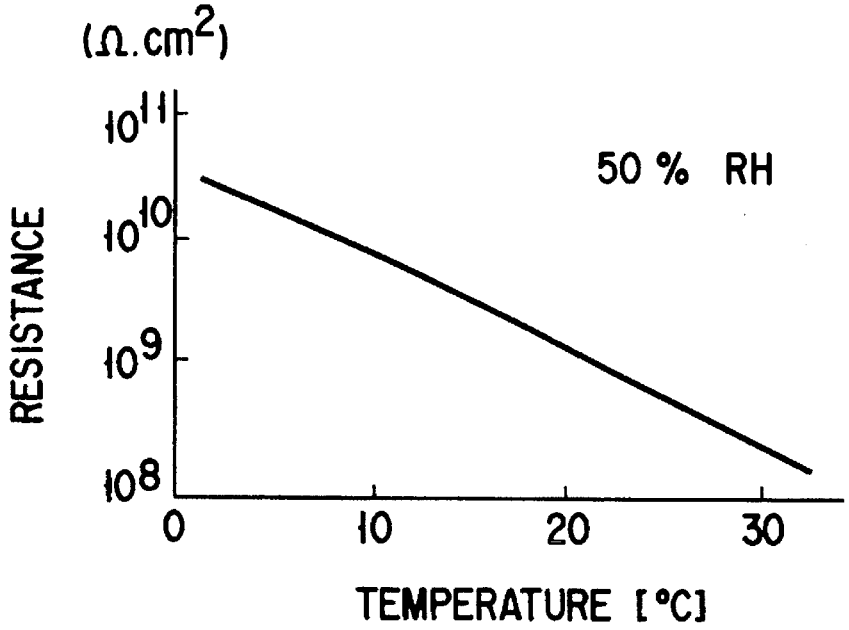
FIG. 17 is a graph showing the temperature-resistance characteristic curve of the transfer roller.

Second, as shown in FIG. 17, a transfer roller 51 is formed such that it has temperature-resistance characteristics wherein the electric resistance changes by about ten to thousand times in the temperature range of 0° C. to 40° C.

With these structures, since the electric resistance of the transfer roller 51 changes in the same manner as a change in electric resistance of the printing sheet P, the distribution ratio of the voltage to the respective resistor components shown in FIGS. 14A to 14C can be maintained the same. Then, a constant electric field can always be kept generated between the photosensitive drum 1 and the transfer roller 51. As a result, high-quality image printing can always be performed regardless of the ambient environment.

As described above, according to the present invention, there is provided a transfer device for electrophotographic apparatus for decreasing the influence of the change in electric resistance of the printing sheet accompanying a change in ambient environment, thereby realizing high-quality stable transfer in different environments. According to the present invention, there is further provided a transfer roller used in a transfer device for an electrophotographic apparatus capable of always stably giving charges to the printing sheet which is inserted between the transfer roller and a photosensitive member on which a toner image is formed, thereby stably performing high-quality transfer. Further, according to the present invention, there is provided a transfer roller used in a transfer device for an electrophotographic apparatus capable of decreasing occurrence of center blank. Moreover, according to the present invention, there is provided toner used for an electrophotographic apparatus capable of decreasing occurrence of center blank.

Additional advantages and modifications will readily occur to those skilled in the art. Therefore, the present invention in its broader aspects is not limited to the specific details, representative devices, and illustrated examples shown and described herein. Accordingly, various modifications may be made without departing from the spirit or scope of the general inventive concept as defined by the appended claims and their equivalents. For example, in the above embodiments, the transfer roller 51 is used as a transfer contact element. However, a component other than a roller, e.g., a brush may be used for transfer the toner image to the printing sheet. The present invention is not limited to a facsimile apparatus, and may be applied to a copying machine and a printer.

What is claimed is:

1. A transfer roller used in a transfer device for an electrophotographic apparatus using a toner, the transfer roller comprising:

a sponge layer;

a resistor layer formed on an outer surface of said sponge layer; and a binder layer, located between said sponge layer and said resistor layer, for adhering said sponge layer and said resistor layer when being heated at a predetermined temperature, wherein said sponge layer is formed of a material having an endothermic point at a temperature not more than the predetermined temperature for heating said binder layer.

2. The transfer roller according to claim 1, wherein said binder layer is formed of polyvinyl chloride.

3. The transfer roller according to claim 1, wherein said sponge layer is formed of a conductive urethane sponge.

4. The transfer roller according to claim 1, wherein said resistor layer is formed of polyvinylidene fluoride.

5. The transfer roller according to claim 1, wherein the sponge layer has a hardness of 40 degrees or less in ASKER-C hardness.

6. The transfer roller according to claim 1, wherein the resistor layer has a hardness of 10 degrees in ASKER-C hardness.

7. The transfer roller according to claim 6, wherein the resistor layer has a thickness of 80 μm.

8. The transfer roller according to claim 1, wherein a surface hardness of the transfer roller is 50 degrees or less in ASKER-C hardness.

9. The transfer roller according to claim 1, wherein said toner used in the electrophotographic apparatus is formed of a main resin and wax, the wax being of an amount by weight more than 1.0 times weight of the main resin.

10. The transfer roller according to claim 9, wherein an amount of the wax by weight being less than 4.0 times weight of the main resin.

11. A transfer roller used in a transfer device for transferring a toner attached to a surface of a photosensitive member to a printing sheet, the roller comprising:

a sponge layer having a hardness of 40 degrees or less in ASKER-C hardness;

a resistor layer formed on an outer surface of said sponge layer and having a hardness of 10 degrees in ASKER-C hardness, wherein a surface hardness of the transfer roller is not more than 50 degrees in ASKER-C hardness.

12. The transfer roller according to claims 11, wherein the resistor layer has a thickness of 80 μm.

13. The transfer roller according to claim 11, wherein the sponge layer is formed of a conductive urethane sponge.

14. The transfer roller according to claim 11, wherein the resistor layer is formed of polyvinylidene fluoride.

15. The transfer roller according to claims 11, wherein said toner is formed of a main resin and wax, the wax being an amount by weight more than 1.0 times weight of the main resin.

16. The transfer roller according to claim 15, wherein the amount of the wax by weight is less than 4.0 times the weight of the main resin.

17. A transfer roller used in a transfer device for transferring toner attached to a surface of a photosensitive member to a printing street, wherein a surface hardness of the transfer roller is less than a surface hardness of the photosensitive member.

* * * * *